US008555524B2

(12) United States Patent
Hammerbeck et al.

(10) Patent No.: US 8,555,524 B2
(45) Date of Patent: Oct. 15, 2013

(54) ONE-PIECE FOOTWEAR

(76) Inventors: George Hammerbeck, Clermont, FL (US); Paul J. VanRisseghem, Cincinnati, OH (US); Daniel R. Blondeau, Kowtoon (HK)

( * ) Notice: Subject to any disclaimer, the term of this patent is extended or adjusted under 35 U.S.C. 154(b) by 319 days.

(21) Appl. No.: 12/828,485

(22) Filed: Jul. 1, 2010

(65) Prior Publication Data

US 2011/0016745 A1 Jan. 27, 2011

Related U.S. Application Data

(60) Provisional application No. 61/270,072, filed on Jul. 2, 2009.

(51) Int. Cl.
*A43B 3/12* (2006.01)

(52) U.S. Cl.
USPC ..... 36/11.5

(58) Field of Classification Search
USPC ..... 36/102, 103, 11.5, 9 R, 94, 8.1, 7.5, 43, 36/44, 3 B, 95; D2/916–918, 932, 939
See application file for complete search history.

(56) References Cited

U.S. PATENT DOCUMENTS

| | | | | | |
|---|---|---|---|---|---|
| 966,821 | A * | 8/1910 | Gaw | 280/841 |
| 2,238,274 | A * | 4/1941 | Lyness | 36/11.5 |
| 2,932,097 | A * | 4/1960 | George | 36/11.5 |
| 3,066,678 | A * | 12/1962 | Riecken | 36/166 |
| 3,275,002 | A * | 9/1966 | Scholl | 36/140 |
| 3,640,006 | A * | 2/1972 | Kendrick | 36/8.1 |
| 4,030,212 | A * | 6/1977 | Ito | 36/11.5 |
| 5,615,496 | A | 4/1997 | Sharpstein | |
| D381,797 | S * | 8/1997 | Bishop | D2/969 |
| 5,737,853 | A * | 4/1998 | Smejkal | 36/11.5 |
| 6,298,580 | B1 | 10/2001 | Tadayon | |
| 6,792,697 | B2 * | 9/2004 | Wright et al. | 36/11.5 |
| 2004/0000070 | A1 | 1/2004 | Wright et al. | |
| 2004/0055179 | A1 * | 3/2004 | Wang | 36/11.5 |
| 2008/0052964 | A1 * | 3/2008 | Taylor | 36/100 |
| 2009/0113759 | A1 * | 5/2009 | Heid | 36/92 |

OTHER PUBLICATIONS

International Search Report and Written Opinion from corresponding PCT application No. PCT/US2010/040714 dated Feb. 24, 2011, 8 pgs.

International Preliminary Report on Patentability and from corresponding PCT application No. PCT/US2010/040714 dated Jan. 12, 2012, (5 pgs).

* cited by examiner

*Primary Examiner* — Khoa Huynh
*Assistant Examiner* — Jameson Collier
(74) *Attorney, Agent, or Firm* — Brinks Hofer Gilson & Lione

(57) ABSTRACT

A footwear article that is a flat sheet of material that can be rolled up and which is configured to be coupled to a wear's ankle and at least one of the wearer's toes. The sheet of material includes a through-hole at one end that is configured to receive a wearer's ankle and at least toe strap at an opposite end configured to receive a wearer's toe(s). According to one embodiment the at least one toe strap is defined by and between a pair of slits formed in the sheet of material. When worn the through-hole surrounds a wearer's ankle and the web or toe strap(s) extends over one of more toes of the wearer.

17 Claims, 3 Drawing Sheets

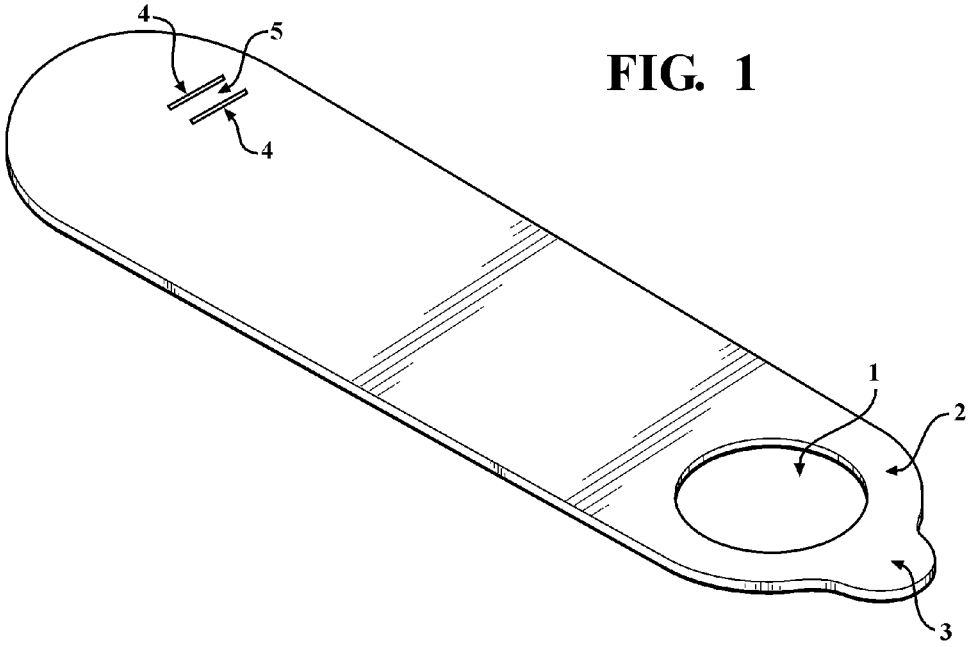
FIG. 1
FIG. 2
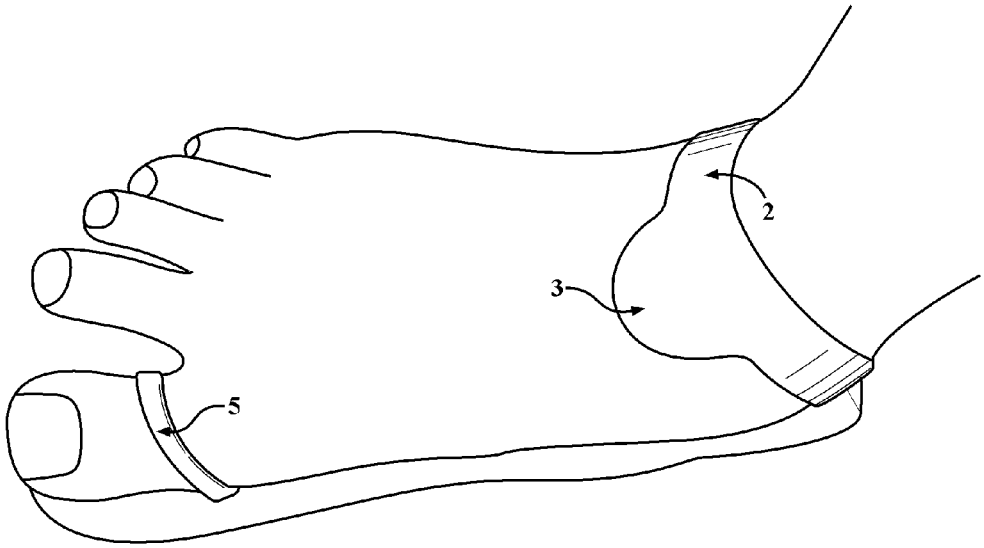

FIG. 5
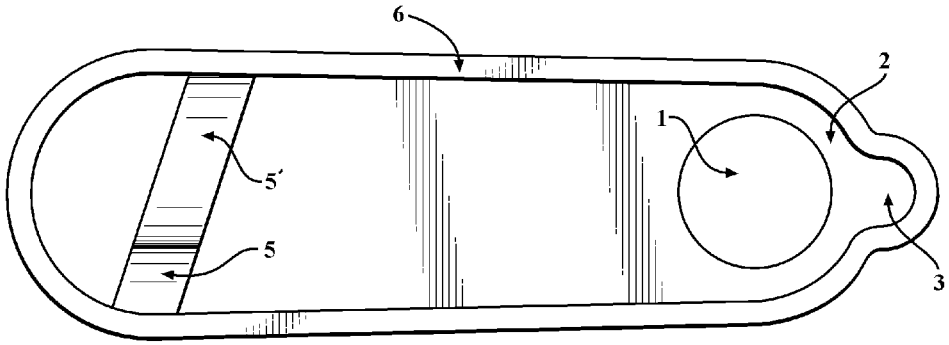
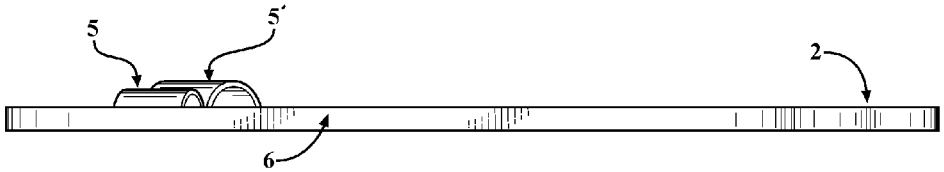
FIG. 6
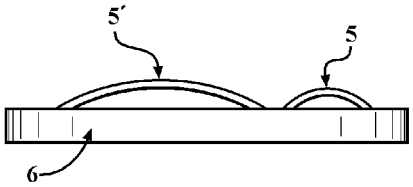
FIG. 7

ONE-PIECE FOOTWEAR

RELATED APPLICATION

The present application is based on U.S. Provisional Patent Application Ser. No. 61/270,072, filed Jul. 2, 2009 to which priority is claimed under 35 U.S.C. §120. The entire disclosure of U.S. Provisional Patent Application Ser. No. 61/270,072 is hereby expressly incorporated herein by reference.

TECHNICAL FIELD

The present invention relates to footwear and more particularly is directed to a one-piece pad design that is configured and designed to be coupled to a wearer's foot so as to cover the sole of the foot.

BACKGROUND ART

There are numerous styles of footware that are designed to be simple and easily worn. One popular design is the "flip-flop" which comprises a pad than has a single strap that, when worn, extends from between one's large and second toes to opposite side portions on the pad. The rear portion of the pad is not connected to the wearer's foot and thus "flops" when the wearer walks.

Another simple type of footware includes a pad and a single wide strap that, when worn, extends laterally across one's foot over one's materials.

Other types of footwear include water shoes and water boots that enclose one's feet.

The present invention provides a simple, easy to wear one-piece footware article that covers and protects the bottom or sole of one's feet.

DISCLOSURE OF THE INVENTION

According to various features, characteristics and embodiments of the present invention which will become apparent as the description thereof proceeds, the present invention provides a footwear article that includes a sheet of material that has an elongated configuration with a through-hole at one end and at least one pair of slits at an opposite end which define a web or toe strap between the pair of slits, wherein the sheet of material has a transverse center that extends longitudinally and the through-hole has a center that lies on the transverse center of the sheet of material and at least one pair of slits are positioned on the same side of the transverse center of the sheet of material.

The present invention further provides a footwear article that includes a sheet of material that has an elongated configuration with a through-hole at one end and at least one toe strap at an opposite end, wherein when worn on the foot of a wearer the footwear article is coupled only to wearer's ankle and a toe of the wearer.

The present invention also provides a footwear article that includes a flat sheet of material that can be rolled up and which is configured to be coupled to a wear's ankle and at least one of the wearer's toes.

The present invention further provides footwear article that includes a sheet of material that has a top surface, bottom surface and an elongated configuration with a through-hole at one end and at least one toe strap at an opposite end which extends upward from the top surface, wherein the sheet of material has a transverse center that extends longitudinally and the through-hole has a center that lies on the transverse center of the sheet of material and the at least strap is positioned on one side of the transverse center of the sheet of material.

BRIEF DESCRIPTION OF DRAWINGS

The present invention will be described with reference to the attached drawings which are given as non-limiting examples only, in which:

FIG. 1 is a perspective view of a footwear article according to one embodiment of the present invention.

FIG. 2 is a top view of foot having the footwear article of FIG. 1 coupled thereto.

FIG. 5 is a top view of the footware article of FIG. 4.

FIG. 6 is a side planar view of the footware article of FIG. 4.

FIG. 7 is a front planar view of the footware article of FIG. 4.

BEST MODE FOR CARRYING OUT THE INVENTION

Figure 3:
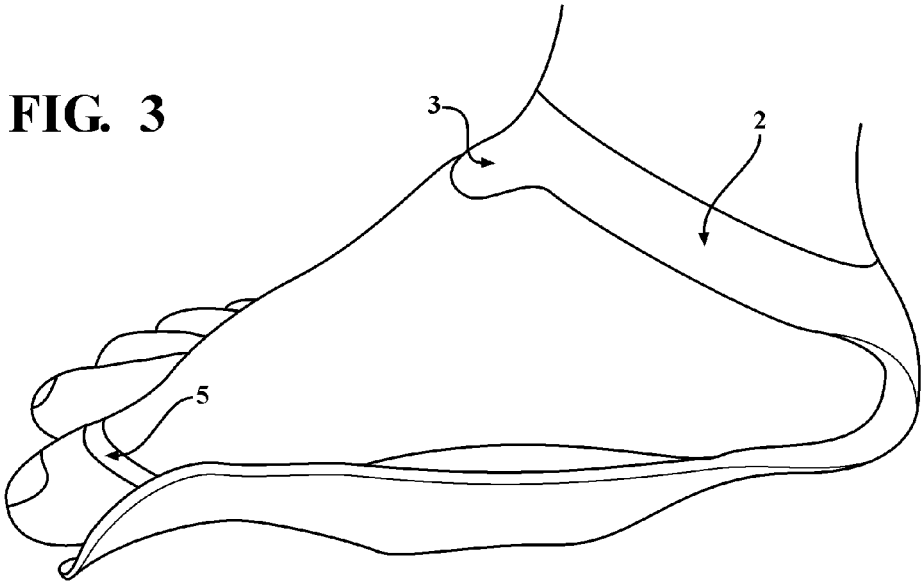
FIG. 3 is a side view of foot having the footwear article of FIG. 1 coupled thereto.

The present invention is directed to a one-piece footwear article or pad that is configured and designed to be coupled to a wearer's foot so as to cover the sole of the foot. The one-piece footwear article or foot pad of the present invention comprises a sheet of material (referred herein as a "base" or "base material") that has a particular shape that allows it to be coupled to a person's foot.

The sheet of material can comprise a single or multiple layered sheet, or mat or web or laminate or other similar structure. The material of the sheet can be flexible, resilient, elastic, woven, non-woven, etc. One material that was determined to be particularly suitable during the course of the present invention is neoprene or neoprene fabrics. Other examples of materials include silicon, neoprene, natural rubber foams, synthetic rubber foams and polyurethane, polyether and polyester foams neoprene, vinyl nitrile, styrene-butadiene rubber (SBR), polyethylene (PE), ethyl vinyl acetate (EVA), ethylene propylene terpolymer (EPT), EPT/PE/butyl rubber, neoprene/EPT/SBR, epichlorohydrin (ECH), and nitrile (NBR) or a combination thereof. In addition suede, other soft flexible leathers and other synthetic materials can be used. The sheet of material can be thin and still protect the wearer's sole or relatively thick to provide a desired degree of padding.

FIG. 1 is a perspective view of a footwear article according to one embodiment of the present invention. The footwear article depicted in FIG. 1 is a sheet of material that is elongated in a longitudinal direction and has a length that is greater than the length of a wearer's foot as will be understood from the description which follows. The footwear article has a width in a lateral or transverse direction (perpendicular to the longitudinal direction) that is at least as wide as a wearer's foot.

One end of the sheet of material includes a through-hole 1 that has an inner diameter that is at least as large as the diameter of a wearer's ankle, or can be stretched to fit around a wearer's ankle. In the embodiment depicted in FIG. 1 the through-hole 1 is surrounded by an area of the material sheet that forms a closed strap 2. When wore the strap 2 surrounds a wearer's ankle as discussed below. In the embodiment of the invention depicted in FIG. 1, a tab 3 is provided on the end of the closed strap 2. This tab 3 can be used to pull the footwear onto a wearer's foot as discussed below. In addition, the tab 3 can be used to apply a logo or other indicia such as graphic or textural material to the footwear article. In further embodiments of the invention, the tab 3 can have other shapes or can be eliminated or multiple tabs can be provided.

On an end of the sheet of material opposite to the end having the through-hole 1, a pair of slits 4 are formed in the sheet material. The slits 4 can extend through the entire thickness of the sheet of material or through an upper layer thereof. These slits 4 define a web or toe strap 5 between them which is configured to extend over a wearer's toe(s) as discussed below.

FIG. 2 is a top view of foot having the footwear article of FIG. 1 coupled thereto. FIG. 3 is a side view of foot having the footwear article of FIG. 1 coupled thereto. As shown in FIGS. 2 and 3, the footwear article of the present invention is worn by placing one's foot through the through-hole and wrapping the sheet of material below the wearer's heal and under the wearer's foot and positioning the web or toe strap 5 over the wearer's big toe.

As can be seen, the bottom side of the sheet of material that extends beneath the bottom of the wearer's foot or sole becomes the top side around the through-hole 1. This bottom side is a skin non-contactable side. The opposite or top or skin-contactable side can have a soft finish such as a brushed finish, a soft fabric finish, a flocked finished, etc., if desired. At least a portion of the bottom side of the sheet of material immediately beneath the wearer's foot bottom or sole can have a surface or be made of a material that resists slipping and/or improves gripping on a variety of surfaces, including smooth and/or wet surfaces.

As noted above, the sheet of material can be made from a variety of materials such as silicon, neoprene, natural rubber foams, synthetic rubber foams and polyurethane, polyether and polyester foams neoprene, vinyl nitrile, styrene-butadiene rubber (SBR), polyethylene (PE), ethyl vinyl acetate (EVA), ethylene propylene terpolymer (EPT), EPT/PE/butyl rubber, neoprene/EPT/SBR, epichlorohydrin (ECH), and nitrile (NBR) or a combination thereof. In addition suede, other soft flexible leathers and other synthetic materials can be used.

As can be understood, from FIGS. 2 and 3 further embodiments of the present invention can have one or more additional webs or toe straps that are positioned and configured to be positioned over one or more toes other than the wearer's big toe.

In addition, at least a portion of the bottom side of the sheet of material immediately beneath the wearer's foot bottom or sole can be padded or have an increased thickness to improve the comfort of the footwear. Further, the strap 2 that surrounds the wearer's ankle can be padded and even have a circular cross-section to improve comfort to the wearer.

According to further embodiments of the present invention, as indicated above, one or more straps or webs can be provided which can be provided and position to extent over one or more or a wearer's toes. FIGS. 4-7 illustrate a non-limited embodiment of the invention in which two straps are provided, it being understood that more than two straps can be used in further embodiments.

Figure 4:
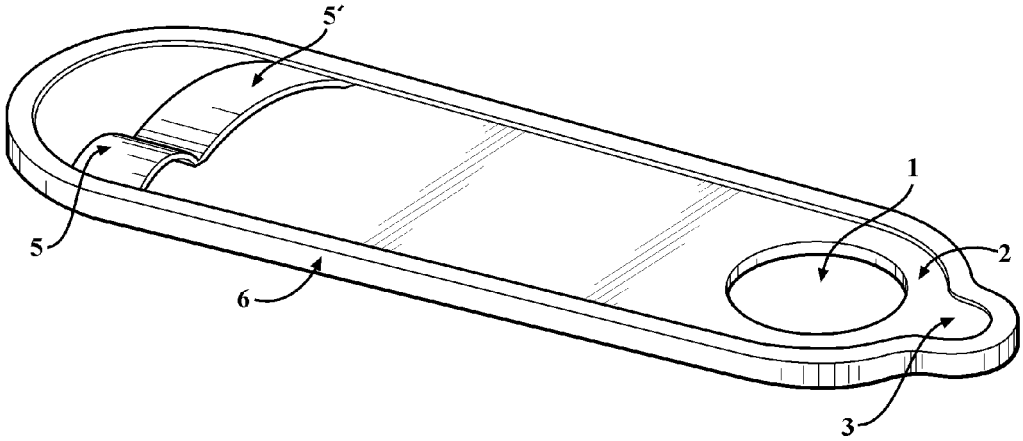
FIG. 4 is a perspective view of a footwear article according to another embodiment of the present invention.

FIG. 4 is a perspective view of a footwear article according to another embodiment of the present invention. In the embodiment of the invention depicted in FIG. 4 (and FIGS. 5-7) the base of the footware article comprises a sheet of material that is elongated in a longitudinal direction and has a length that is greater than the length of a wearer's foot, similar to the other embodiments described herein. The footwear article or base thereof has a width in a lateral or transverse direction (perpendicular to the longitudinal direction) that is at least as wide as a wearer's foot.

One end of the sheet of material includes a through-hole 1 that has an inner diameter that is at least as large as the diameter of a wearer's ankle. In the embodiment depicted in FIGS. 4 and 5 the through-hole 1 is surrounded by an area of the material sheet that forms a closed strap 2. When wore the strap 2 surrounds a wearer's ankle as discussed herein. In the embodiment of the invention depicted in FIGS. 4 and 5, a tab 3 is provided on the end of the closed strap 2. This tab 3 can be used to pull the footwear article onto a wearer's foot as discussed herein. In addition, the tab 3 can be used to apply a logo or other indicia such as graphic or textural material to the footwear article. In further embodiments of the invention, the tab 3 can have other shapes or can be eliminated or multiple tabs can be provided.

Near an end of the sheet of material opposite to the end having the through-hole 1, a pair of straps are provided, including in this embodiment, a toe strap 5 that is configured to receive and extend over a wearer's big toe and a secondary toe strap 5' that is configured to receive and extend over a wearer's remaining toes, including the index, middle, fourth, and little toes.

In this embodiment toe straps 5 and 5' are formed from a narrow strip of material that is separate from the base sheet; howbeit, the toe straps can be formed from the same material as the sheet material of the base. Alternatively, the toe straps can be formed from any suitable fabric, such as nylon, polyester, cotton, etc., a braded or woven material, leather, or the like. The toe straps 5 and 5' can be formed from a single strip of material and secured to the base sheet at opposite ends and between the toe straps 5 and 5'. The opposite or outer ends of the toe straps 5 and 5' can be secured to the base sheet by any suitable means including mechanical means such as sewing, stapling, etc. and/or by chemical means such as adhesives. The opposite or outer ends can be secured by or together with the piping depicted in FIGS. 4-7. In the case of a laminated base sheet, the opposite or outer ends of the toe straps 5 and 5' and portion between the toe straps 5 and 5' can be inserted beneath one of more layers of the laminate and secured therebetween again using mechanical and/or chemical means.

In FIG. 4 piping 6 is provided along the edge of the base of the footwear article. The piping 6 reinforces and protects the edge from being scuffed or damaged and adds some rigidity to the base. Such piping can be used on all the embodiments of the invention if desired. It is also within the scope of the present invention to provide piping along the inner edge of through-hole 1.

FIG. 5 is a top view of the footware article of FIG. 4. As shown in FIG. 5, the toe straps 5 and 5' are aligned along an angle which corresponds to the angular shape of a wearer's toes. Alternatively the toe straps could be aligned along the transverse direction of the base.

FIG. 6 is a side planar view of the footware article of FIG. 4. FIG. 7 is a planar front view of the footware article of FIG. 4. In FIGS. 6 and 7 the relative lengths and heights of the toe straps 5 and 5' (before toe insertion) are shown.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above or from the spirit and scope of the present invention as set forth in the attached claims.

What is claimed is:

1. A footwear article that comprises a one-piece, flat sheet of material that has opposed continuous top and bottom surfaces and an elongated configuration with a through-hole formed in one end of the flat sheet of material so as to extend through the opposed continuous top and bottom surfaces and at least one pair of slits at an opposite end of the flat sheet of material which define a web or toe strap between the pair of slits, wherein the flat sheet of material has a transverse center that extends longitudinally and the through-hole has a center that lies on the transverse center of the flat sheet of material and the at least one pair of slits are positioned on one side of the transverse center of the flat sheet of material, said through-hole consisting of a substantially circular shaped through-hole having a continuous circular peripheral inner edge that extends continuously 360° , wherein when worn on the foot of a wearer the peripheral inner edge of the through-hole of the footwear article is attached around the wearer's ankle and the web or toe strap is attached over one or more toes of the wearer and the top surface of the flat sheet of material touches substantially the entire bottom of the wearer's foot and back of heel.

2. A footwear article according to claim 1, wherein the flat sheet of material comprises neoprene.

3. A footwear article according to claim 1, wherein a portion of the flat sheet of material that surrounds the through-hole defines a strap at an adjacent end of the sheet of material which strap is configured to surround a wearer's ankle.

4. A footwear article according to claim 3, further comprising a tab that extends from the strap defined by the through-hole.

5. A footwear article according to claim 1, wherein the flat sheet of material and at least one toe strap is made from materials that allow the footwear article to be rolled up when not being worn.

6. A footwear article that comprises a one-piece, flat sheet of material that has opposed continuous top and bottom surfaces and an elongated configuration with a through-hole formed in one end of the flat sheet of material so as to extend through the opposed continuous top and bottom surfaces and at least one toe strap at an opposite end of the flat sheet of material, said through-hole consisting of a substantially circular shaped through-hole having a continuous circular peripheral inner edge that extends continuously 360° , wherein when worn on the foot of a wearer the peripheral inner edge of the through-hole of the footwear article is attached around the wearer's ankle and the at least one toe strap is attached over one or more toes of the wearer and the top surface of the flat sheet of material touches substantially the entire bottom of the wearer's foot and back of heel.

7. A footwear article according to claim 6, wherein when worn on the foot of a wearer the footwear article is attached around the wearer's ankle and over two or more toes of the wearer and touches substantially the entire bottom of the wearer's foot and heel when worn.

8. The footwear article according to claim 6, wherein the flat sheet of material has a first surface and a second opposite surface and when worn the first surface faces upward beneath the bottom of the wearer's foot and faces downward around the wearer's ankle.

9. The footwear article according to claim 6, wherein when the footwear article is worn, the flat sheet of material wraps around a back of the wearer's heal.

10. A footwear article according to claim 6, wherein the flat sheet of material and at least one toe strap is made from materials that allow the footwear article to be rolled up when not being worn.

11. A footwear article according to claim 10, wherein the at least one toe strap extends between a pair of slits.

12. A footwear article that comprises a one-piece, flat sheet of material that has opposed continuous top and bottom surfaces and an elongated configuration with a through-hole formed in one end of the flat sheet of material so as to extend through opposed continuous said top and bottom surfaces and at least one toe strap at an opposite end of the flat sheet of material which extends upward from the top surface, wherein the flat sheet of material has a transverse center that extends longitudinally and the through-hole has a center that lies on the transverse center of the flat sheet of material and the at least one toe strap is positioned on one side of the transverse center of the flat sheet of material, said through-hole consisting of a substantially circular shaped through-hole having a continuous circular peripheral inner edge that extends continuously 360° , wherein when worn on the foot of a wearer the peripheral inner edge of the through-hole of the footwear article is attached around the wearer's ankle and the at least one toe strap is attached over one or more toes of the wearer and the top surface of the flat sheet of material touches substantially the entire bottom of the wearer's foot and back of heel.

13. A footwear article according to claim 12, wherein the at least one toe strap comprises two straps, one of said toe straps is positioned on one side of a transverse center line and the other toe strap extends across the transverse center line.

14. A footwear article according to claim 12, wherein a portion of the flat sheet of material that surrounds the through-hole defines an ankle strap at an adjacent end of the flat sheet of material which ankle strap is configured to surround a wearer's ankle.

15. A footwear article according to claim 14, further comprising a tab that extends from the ankle strap.

16. The footwear article according to claim 12, further comprising piping that extends along an edge of the flat sheet of material.

17. A footwear article according to claim 12, wherein the flat sheet of material and at least one toe strap is made from materials that allow the footwear article to be rolled up when not being worn.

* * * * *